United States Patent [19]

Keeffe et al.

[11] Patent Number: 4,620,125

[45] Date of Patent: Oct. 28, 1986

[54] LOW WATTAGE METAL HALIDE LAMP WITH INVERTED DOMED SLEEVE

[75] Inventors: William M. Keeffe, Rockport; Zeya K. Krasko, Danvers, both of Mass.; Robert J. Karlotski, Weare, N.H.

[73] Assignee: GTE Products Corporation, Stamford, Conn.

[21] Appl. No.: 665,472

[22] Filed: Oct. 29, 1984

[51] Int. Cl.[4] ..... H01J 61/04; H01J 61/18; H01J 61/34

[52] U.S. Cl. ..... 313/25; 313/634; 313/638

[58] Field of Search ..... 313/25, 634, 489, 638, 313/642

[56] References Cited

U.S. PATENT DOCUMENTS 4,499,396 2/1985 Fohl et al. ..... 313/634 X

FOREIGN PATENT DOCUMENTS 101519 2/1984 European Pat. Off. .
324497 11/1974 Fed. Rep. of Germany .
852783 11/1960 United Kingdom ..... 313/25

*Primary Examiner*—David K. Moore
*Assistant Examiner*—K. Wieder
*Attorney, Agent, or Firm*—Jose' W. Jimenez; Thomas H. Buffton

[57] ABSTRACT

A low wattage metal halide discharge lamp includes an evacuated envelope wherein is disposed a heat reducing member having an arc tube therein. The heat reducing member and the arc tube have a metal band an outer strap member adjacent one another and adjacent an electrode with the metal band, strap member and electrode all electrically connected to an electrical lead of one polarity whereby sodium losses from the arc tube are reduced. Importantly, the evacuated envelope includes a getter and the heat reducing member is in the form of a domed sleeve having an open end directed away from the getters.

8 Claims, 2 Drawing Figures

LOW WATTAGE METAL HALIDE LAMP WITH INVERTED DOMED SLEEVE

TECHNICAL FIELD

This invention relates to low wattage metal halide discharge lamps and more particularly to low wattage metal halide discharge lamps configured to reduce sodium losses.

BACKGROUND ART

Generally, metal halide discharge lamps are of the intermediate or relatively high wattage variety such as about 175 to 1500 watts for example. Also it is known that the efficacy of the lumen output to input power decreases as the wattage of the lamp decreases. Thus, it has been generally presupposed that at lower wattages, wattages of 100 watts or less, metal halide discharge lamps would be entirely unsatisfactory in so far as efficacy is concerned.

Also, it has been a common practice in the intermediate and relatively high wattage lamps to provide an inert fill gas in the outer envelope in order to prevent oxidation of metal parts of the arc tube mount. Another advantage of an inert gas fill in an outer envelope in a high breakdown voltage which prevent arcing between metal parts of the arc tube mount. However an undesired heat loss due to convention currents of the inert gas in the outer envelope reduces the lamp efficacy significantly.

One known attempt to reduce these undesired heat losses due to convection currents is disclosed in U.S. Pat. No. 4,499,396 to Fohl et al., issued on Feb. 12, 1985 and assigned to the Assignee of the present application. Therein, a quartz envelope is disposed within the gas filled outer envelope of a metal halide discharge lamp in an effort to reduce heat losses due to convection currents.

Another attempt to reduce undesired heat loss due to convection currents is set forth in U.S. Pat. No. 4,281,274. Therein, a glass cylinder surrounds an arc tube within an outer glass envelope. The outer glass envelope includes one or more lamp filaments and is filled with a gas under pressure. Thus, a glass cylinder and a gas filled outer envelope are employed to reduce the heat loss due to convection currents. However, structures having gas filled envelopes and accompanying convection currents leave something to be desired in reduction of heat loss in so far as relatively high pressure lamps are concerned.

OBJECTS AND SUMMARY OF THE INVENTION

An object of the present invention is to overcome the difficulties of the prior art. Another object of the invention is to provide a low wattage metal halide discharge lamp having reduced heat losses. Still another object of the invention is to provide an improved low wattage metal halide discharge lamp. A further object of the invention is to reduce thermal differences in a low wattage metal halide discharge lamp.

These and other objects, advantages and capabilities are acheived in one aspect of the invention by a low wattage metal halide discharge lamp having a chemically-filled arc tube with an electrode at each end, a heat reducing means in the form of a domed quartz sleeve having an open end and an evacuated outer envelope having a getter at one end with the open end of the quartz sleeve facing and adjacent the end of the evacuated outer envelope opposite from the end having a getter therein.

BEST MODE FOR CARRYING OUT THE INVENTION

For a better understanding of the present invention, together with other and further objects, advantages, and capabilities thereof, reference is made to the following disclosure and appended claims in conjunction with the accompanying drawings.

Figure 1:
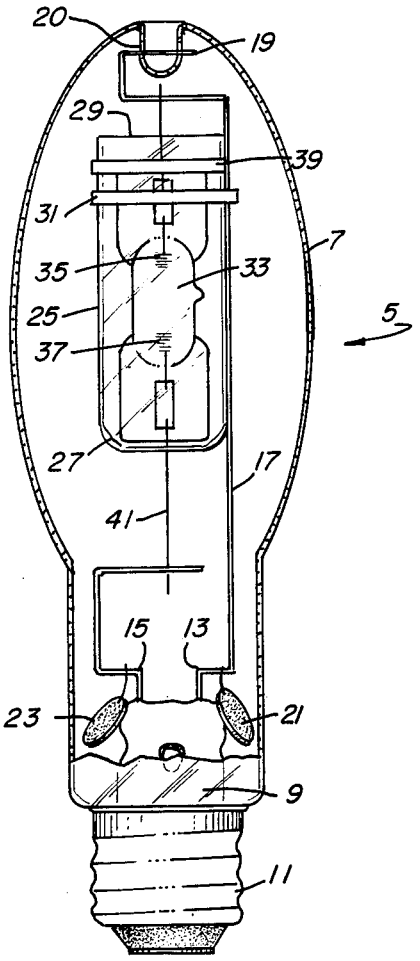
FIG. 1 is a cross-sectional view of one embodiment of a low wattage metal halide discharge lamp of the invention.

Referring to the drawings, FIG. 1 illustrates a low wattage metal halide discharge lamp 5 which, importantly, includes an evacuated outer envelope 7. This evacuated outer envelope 7 is hermetically sealed to a glass stem member 9. An external base 11, formed for easy connection to an electrical source, is affixed to the hermetically sealed stem member 9 and outer envelope 7. A pair of electrical conductors 13 and 15 are sealed into and pass through the stem member 9 and electrically connected to the base 11 external of the outer envelope 7 to provide access for energization of the discharge lamp 5.

Within the evacuated outer envelope 7 and affixed to one of the electrical conductors 13 is an electrically conductive support member 17. This electrically conductive support member 17 extends along an axis substantially parallel to the longitudinal axis of the discharge lamp 5 and includes a circular configuration 19 at or near the upper most portion 20 of the outer envelope 7. This circular configuration 19 in conjunction with the upper most portion 20 of the outer envelope 7 serve to maintain the support member 17 in proper alignment and resistant to deformation due to external shock to the discharge lamp 5.

Also disposed within the evacuated envelope 7 and affixed to the electrical conductors 13 and 15 therein are a pair of barium getters 21 and 23 respectively. These barium getters 21 and 23 are positioned at one end of the outer envelope 7 and adjacent to the glass stem member 9 and external base 11. As is well known, these barium getters 21 and 23 are important in any structure wherein an evacuated or vacuum is desired such as the above-described evacuated outer envelope 7.

Disposed within the evacuated envelope 7 is a heat reducing member 25 in the form of a domed quartz sleeve. This heat reducing member 25 includes a domed portion 27, which is positioned closest to the getters 21 and 23 and base 11, and an open-ended portion 29 which is furthest from and faces away from the getters 21 and 23 and base 11. A metal band 31 surrounds and is affixed to the heat reducing member 25 and is electrically and mechanically connected to the support member 17.

Within the heat reducing means 25 is an arc tube 33. This arc tube 33 has a chemical fill including a sodium halide and in a preferred embodiment includes iodides of sodium and scandium of a ratio in the range of about 20:1 to 28:1. The arc tube 33 also includes an electrode, 35 and 37 at each end thereof with a metal strap member 39 affixed to the outer surface thereon and electriclly and mechanically connected to the support member 17. Moreover, the electrode 35 is mechanically and electrically connected to the support member 17 while the other electrode 37 is affixed to an electrical conductor 41 which passes through the dome portion 27 of the heat reducing member 25 and is electrically and mechanically connected to the other electrical connector 15. Importantly, the metal strap member 39 is immediately adjacent the metal band 31 affixed to the heat reducing member 25 and the one electrode 35 of the arc tube 33. Moreover, the strap member 39, metal band 31 and one electrode 35 are all electrically connected to the support member 17 and to the one electrical conductor 13.

Figure 2:
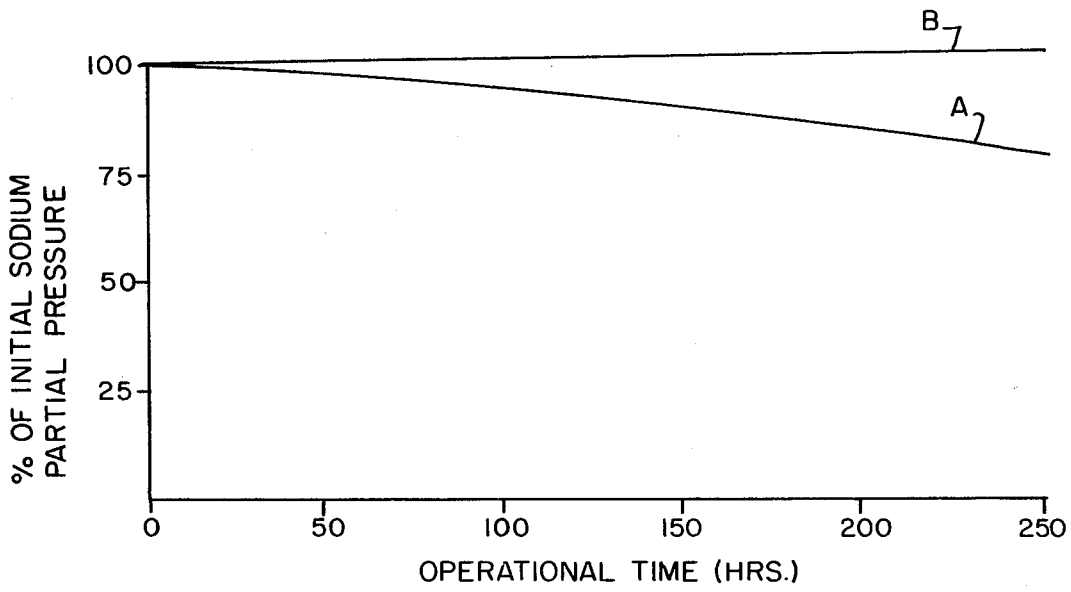
FIG. 2 is a chart comparing the sodium losses from a metal halide discharge lamp wherein the open end of a quartz sleeve faces toward a gettering source (Curve A) and the open end of a quartz sleeve faces away from a gettering source (Curve B).

Referring to FIG. 2 of the drawings, Curve A illustrates the sodium loss during 250-hours of operational life for a 100-watt metal halide lamp when the open end 29 of the quartz sleeve 25 is directed toward the getters 21 and 23 within the outer evacuated envelope 7. As can readily be seen an undesired loss of about 18% in sodium over a 250 period of operation is encountered.

However, in accordance with one concept of the present invention, Curve B illustrates the loss in sodium when a domed quartz sleeve 25 is positioned such that the dome end 27 is adjacent the getters 21 and 23 and the open end 29 of the quartz sleeve 25 is aimed in a direction opposite from the getters 21 and 23. Thus, no direct line of sight path between the getters 21 and 23 and the inside of the sleeve 25 is present. Accordingly, there is essentially and desirably practically no loss of sodium.

Further, it has been found that the color temperature of a metal halide lamp having the open end 29 of the quartz sleeve 25 directed away from the getters 21 and 23 experiences a color temperature change of not more than about 30° K. On the other hand, a structure wherein the open end 29 of the quartz sleeve 25 is directed toward the getters 21 and 23 undesirably provided a color temperature change of about 400° K. after 250-hours of operation.

Accordingly, it has been found that a metal halide discharge lamp wherein a heat reducing member has an open end which is aimed in a direction away from the getters in an evacuated envelope provides a reduced loss of sodium during operation as compared with structural configurations wherein the open end of the heat reducing member is aimed in a direction toward the getters. Further, it has also been found that sodium losses are reduced when an electrode of the arc tube, adjacent outer strap member on the arc tube and an adjacent outer metal band on the heat reducing member are all connected to the same electrical conductor providing one voltage polarity.

Although the exact mechanism is not fully understood, it has been found that the barium getter necessary to an evacuated outer envelope has a deleterious effect upon sodium content of a metal halide discharge lamp when a line-of-sight path between the getter and the inner portion of a heat reducing member or domed quartz sleeve is present. In other words, interruption of the above-mentioned line-of-sight path by inverting the domed bulb greatly reduces the sodium loss during operation of the lamp.

While there has been shown and described what is at present considered the preferred embodiments of the invention, it will be obvious to those skilled in the art that various changes and modifications may be made therein without departing from the invention as defined by the appended claims.

We claim:

1. A metal halide discharge lamp comprising:

an arc tube having a chemical fill including a sodium halide, an electrode therein at each end thereof and an outer strap member affixed thereto;

a heat reducing member in the form of a sleeve having a domed end and an open end with an outer metal band affixed thereto, said sleeve surrounding said arc tube;

an evacuated outer envelope surrounding said heat reducing member, said envelope having a pair of electrical conductors sealed therein and passing therethrough and at least one getter at one end therein;

said outer strap member, one of said electrodes of said arc tube and said outer metal strap of said heat reducing member electrically coupled to one of said pair of electrical conductors and the other electrode of said arc tube electrically coupled to the other one of said pair of electrical conductors;

and means for reducing sodium loss that includes positioning said domed end of said heat reducing member toward said getter thereby interrupting the line-of-sight between said getter and the inside of said heat reducing member.

2. The metal halide discharge lamp of claim 1 wherein said evacuated outer envelope has a getter at one end thereof and a base member externally affixed to said one end with said open end of said heat reducing member facing away from said one end having said getter and base and toward the opposite end of said envelope.

3. The metal halide discharge lamp of claim 1 wherein said evacuated outer envelope has a base affixed to said one end having said getter therein, said domed end of said sleeve is adjacent and facing said getter and said lamp is operated in an upright position with said base above said envelope.

4. The metal halide discharge lamp of claim 1 wherein said outer strap member of said arc tube is adjacent an electrode at one end thereof, said outer metal band of said heat reducing member is adjacent said outer strap member and said outer strap member, adjacent electrode and adjacent outer metal band are electrically and mechanically connected to one of said pair of electrical conductors and the electrode at the other end of said arc tube is electrically connected to the other one of said pair of electrical conductors of said evacuated envelope.

5. A low wattage metal halide discharge lamp having low sodium losses comprising:

an evacuated outer envelope having a getter within and positioned at one end thereof and a base member externally affixed to said one end thereof;

a pair of electrical conductors sealed into and passing through said one end of said envelope and electrically connected to said base member;

a heat reducing member in the form of a sleeve having a domed end and an open end disposed within said evacuated envelope, said member having a metal band affixed thereto adjacent said open end with said domed end adjacent and facing said getter at said one end of said evacuated outer envelope and said open end facing away from said getter;

an arc tube disposed within each heat reducing member, said arc tube having an electrode at each end thereof and an outer strap member affixed to one end adjacent an electrode and adjacent said metal band of said heat reducing member; and means for reducing sodium loss from said arc tube that includes electrically coupling said outer strap member and adjacent electrode of said arc tube and said metal band of said heat reducing member adjacent with outer strap member to one of said pair of electrical conductors and said electrode at the opposite end of said arc tube to the other one of said pair of electrical conductors whereby said domed end of said heat reducing member interrupts a line-of-sight path into said heat reducing member from said getter.

6. The low wattage metal halide discharge lamp of claim 5 wherein said lamp is a 100-watt lamp and said sodium content remains substantially constant after about 250-hours of operational use.

7. The low wattage metal halide discharge lamp of claim 5 wherein said electrode at the opposite end of said arc tube is electrically connected through said domed end of said sleeve of said heat reducing member.

8. The low wattage metal halide discharge lamp of claim 5 wherein said lamp has a change in color temperature of not more than about 30° K. after 250 hours of operation.

* * * * *